US005992810A

United States Patent [19]

Crinion et al.

[11] Patent Number: 5,992,810

[45] Date of Patent: Nov. 30, 1999

[54] ADJUSTABLE KEYBOARD SUPPORT

[75] Inventors: Jonathan Crinion, Toronto; John Laperle, Cornwall; Lee Kenyon, Sharon; Hanna Shaheen, Scarborough; Dragan Grbic, Victoria, all of Canada

[73] Assignee: Ergotech (1993) Inc., Scarborough, Canada

[21] Appl. No.: 08/921,697

[22] Filed: Sep. 2, 1997

[51] Int. Cl.[6] ..... A47B 9/02

[52] U.S. Cl. ..... 248/284.1; 248/918; 108/8; 108/50.01; 108/147

[58] Field of Search ..... 248/284.1, 281.11, 248/917, 918, 919, 920, 921, 922, 923, 280.11, 118, 118.1, 118.3; 108/65, 69, 93–138, 143, 140, 5, 8, 50.01, 96, 108, 147

[56] References Cited

U.S. PATENT DOCUMENTS

| | | | |
|---|---|---|---|
| 4,632,349 | 12/1986 | Anstey | 248/281.11 |
| 4,643,382 | 2/1987 | Ojima et al. | 248/921 X |
| 4,844,387 | 7/1989 | Sorgi et al. | 248/284.1 X |
| 4,938,441 | 7/1990 | Hannah et al. | 248/248 |
| 5,277,392 | 1/1994 | Rossman et al. | 248/919 X |
| 5,398,622 | 3/1995 | Lubinskas et al. | 248/281.11 X |
| 5,490,466 | 2/1996 | Diffrient | 108/96 |
| 5,743,503 | 4/1998 | Voeller et al. | 248/284.1 |
| 5,791,263 | 8/1998 | Watt et al. | 248/918 X |
| 5,799,917 | 9/1998 | Li | 248/284.1 |

*Primary Examiner*—Ramon O. Ramirez
*Assistant Examiner*—Stephen S. Wentsler

[57] ABSTRACT

A height adjustable keyboard support for attachment to and support from a work surface comprising two mounting brackets for attachment to a work surface. A rigid subassembly has a pair of horizontally spaced pivotting support arms rigidly connected at one end thereof by an intermediate member such that said support arms maintain the relationship therebetween. The subassembly is pivotally secured to the work surface by mounting brackets. A tiltable keyboard mounting arrangement is located generally between the support arms and is controlled by a linkage. An adjustable in length link extends between the subassembly and one of the mounting brackets and maintains the subassembly in a desired position and allows adjustment of said position by adjusting the length of the adjustable link. The link can have one end thereof secured in a slot with gravity biasing the link to one end of the slot. The slot allows the keyboard support to move upwardly if required to avoid pinning of an operator's legs therebeneath.

7 Claims, 4 Drawing Sheets

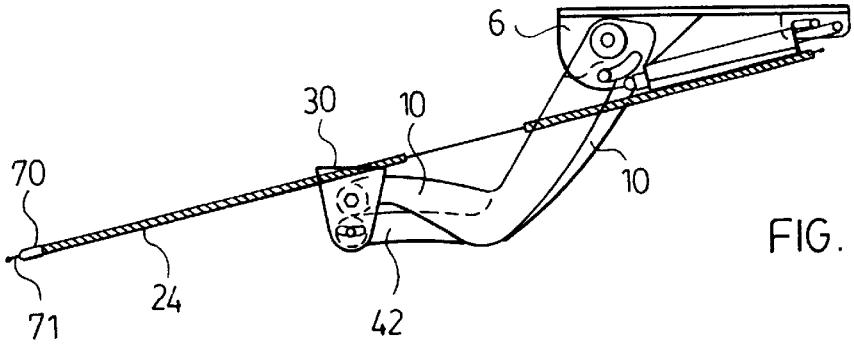
FIG. 3.
FIG. 4.
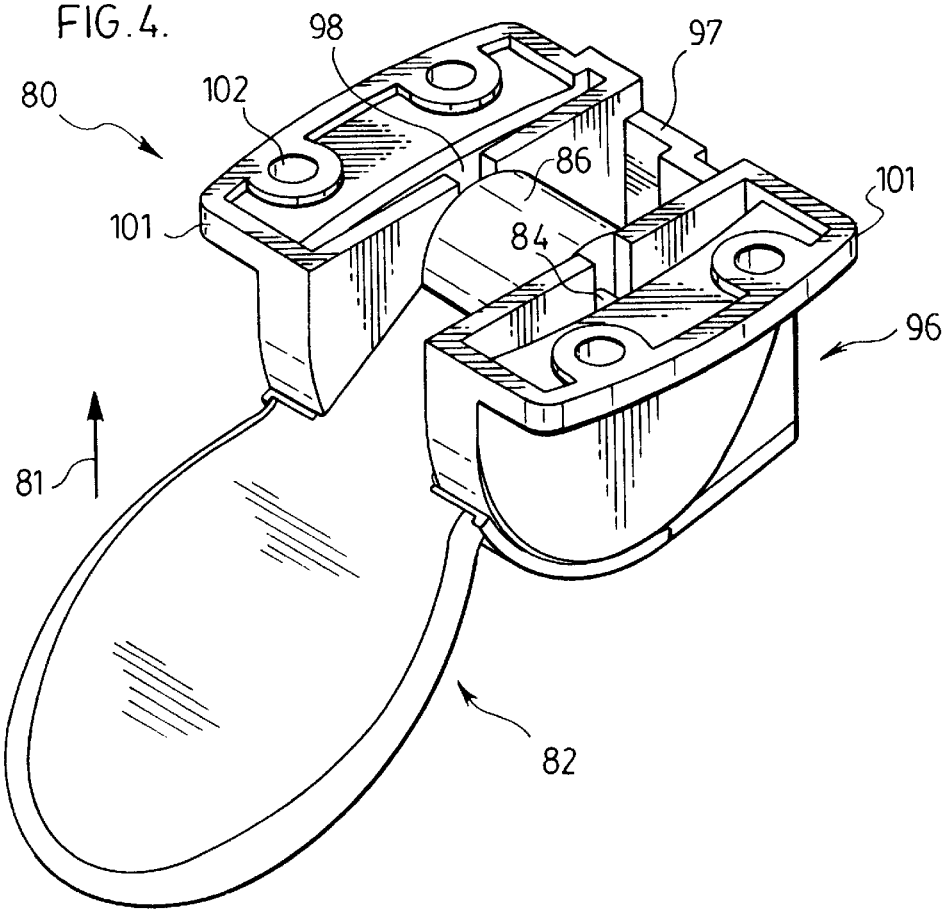

ADJUSTABLE KEYBOARD SUPPORT

BACKGROUND OF THE INVENTION

The present invention relates to keyboard supports to be attached to work surfaces and in particular relates to an height adjustable keyboard support arrangement.

There are many examples of adjustable keyboard support arrangements for attachment to and adjacent one edge of a work surface. These different arrangements can be subdivided into two design types. The first design is a monoarm arrangement which can either be fixed to the underside of the work surface or is slidably mounted beneath the work surface. The keyboard or keyboard support surface is mounted to the central arm and basically extends either side of the central arm. With this arrangement, the monoarm is positioned centrally and can include a parallel linkage arrangement or other adjustable arm mechanisms for varying the support height for the keyboard.

The second design uses two parallel arm mechanisms interconnected by a central member. These arms are widely spaced and support the keyboard support surface generally adjacent either end of thereof. An example of such a mechanism is shown in U.S. Pat. No. 5,398,622. These parallel support arm mechanisms can be slidably attached beneath a work surface or can be fixed to the work surface. The mechanism can include different types of linkages either for maintaining the angle of the keyboard support surface with changes in height or allowing some correction in the angle as the height of the keyboard support work surface is changed.

With these mechanisms, an operator can adjust the height of the keyboard and adjust the angle of the keyboard according to their own preference. It also allows different operators to adjust the keyboard support work surface according to their own preference.

Both the monoarm design and the two parallel arm arrangement restrict the clear area beneath the work surface and keyboard surface. This restricts the leg space available to the operator. Furthermore, it can be appreciated that the keyboard support work surface extends from one side of the work surface and an operator often has their legs beneath the keyboard support which can be at a relatively low position. Should the operator have to stand up quickly or should the height of the work surface change quickly, the keyboard support surface can result in undesired contact with the operator's thighs.

Both the monoarm design and the twin parallel arm mechanisms are known to have a counterbalance arrangement for safety and to ease adjustment in the height of the keyboard.

SUMMARY OF THE INVENTION

A height adjustable keyboard support for attachment to and support from a work surface according to the present invention comprises two mounting brackets for attachment to the work surface, a rigid subassembly comprising a pair of horizontally spaced pivoting support arms rigidly connected at one end thereof by an intermediate member such that the support arms maintain the relationship therebetween, with this subassembly being pivotally secured to each of the mounting brackets to define a pivot axis of the subassembly generally parallel to the intermediate member. Each of the support arms at a distal end thereof includes a tiltable keyboard mounting arrangement located generally between the support arms. The rigid subassembly includes an adjustable in length link extending between the subassembly and one of the mounting brackets. Th[]is adjustable link maintains the subassembly in its desired position and allows adjustment of the position by adjusting the length of the adjustable link. With this arrangement the adjusting mechanism is located beside one of the pivoting support arms leaving the center area of the structure generally unobstructed. According to a preferred aspect of the present invention, the intermediate member is located immediately below the work surface leaving the area between the support arms and beneath the work surface substantially unobstructed.

According to a further aspect of the invention, the adjustable link is a gas cylinder which when released, provides a counterbalance force urging the keyboard mounting arrangement to a raised position.

According to a further aspect of the invention, the height adjustable keyboard support has the adjustable link with one end thereof secured in a slot of the associated mounting bracket with the slot orientated such that gravity of the keyboard support urges one end of the adjustable link to one end of the slot and allows the keyboard to be moved upwardly against gravity if required. This provides a safety feature should the operator stand up quickly or should the keyboard support strike the operator's legs.

According to an aspect of the invention, the height adjustable keyboard support has the adjustable link locked and biased by gravity such that one end of the adjustable link is fixed at one end of a slot. The slot is orientated such that an upward force on the keyboard support arrangement allows the keyboard support surface to move upwardly. Gravity provides the necessary force to maintain the keyboard in the operating position.

According to a further aspect of the invention, the height adjustable keyboard support includes a parallel link mechanism associated with one of the support arms and the keyboard mounting arrangement to maintain the set angle of the keyboard mounting arrangement during height adjustment of the keyboard support. In this way, the height of the keyboard support may be adjusted and the parallel link mechanism maintains the set angle of the keyboard. The angle of the keyboard is separately adjustable and lockable at a desired angle.

BRIEF DESCRIPTION OF THE DRAWINGS

Preferred embodiments of the invention are shown in the drawings, wherein:

FIG. 3 is a side view of the height adjustment mechanism;

FIG. 4 is a top perspective view of a paddle actuator; and

DETAILED DESCRIPTION OF THE PREFERRED EMBODIMENTS

Figure 1:
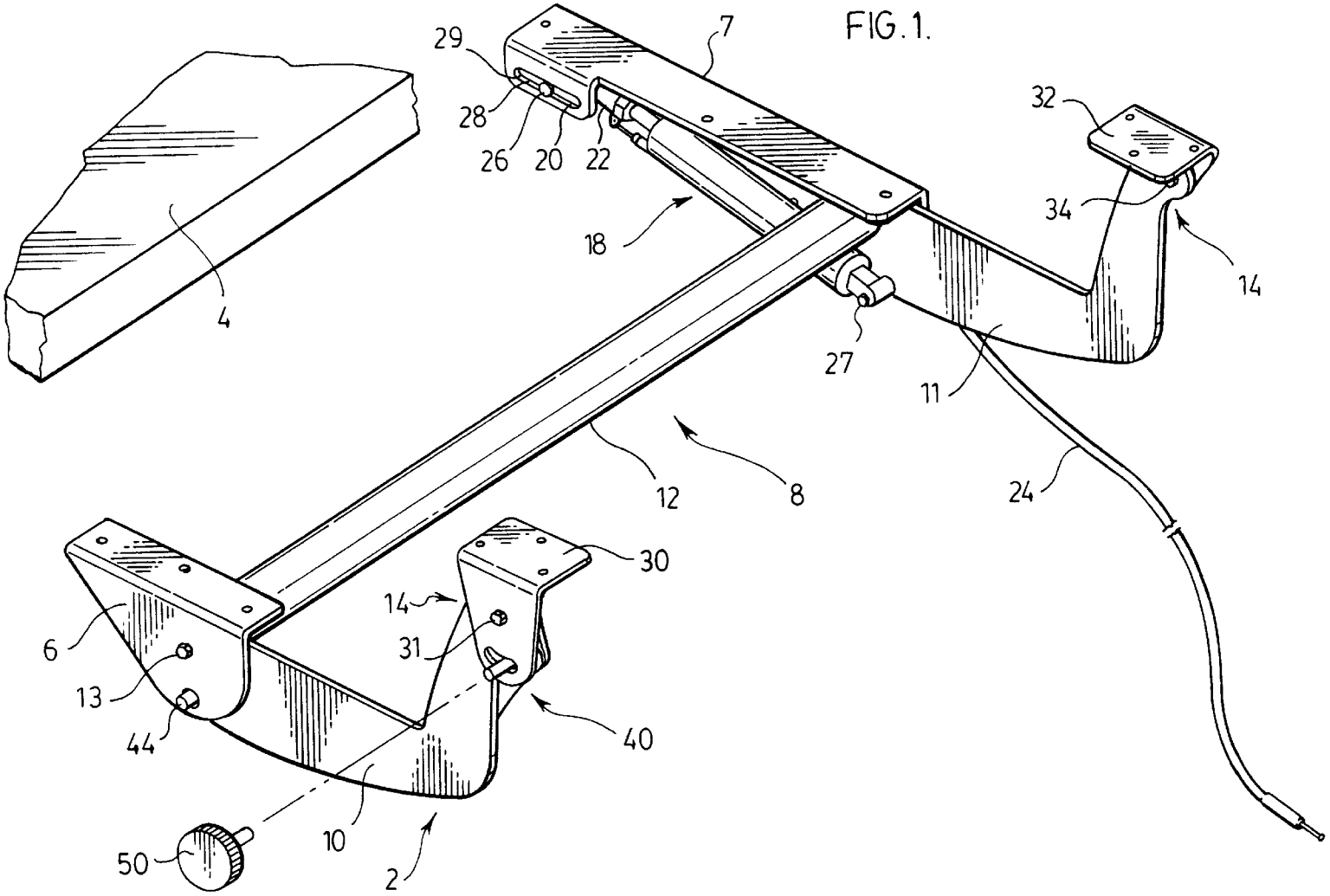
FIGS. 1 and 2 are perspective views of the height adjustable keyboard support mechanism.

The height adjustable keyboard support 2 is designed to be attached to the bottom of a work surface 4 along one edge thereof. The attachment is shown as mounting brackets 6 and 7 which, in this case, can be mechanically fastened by screws, for example, to the work surface 4. It is also possible to have the mounting brackets 6 and 7 slidably attached beneath the work surface for altering the spacing of the keyboard support from the front edge of the work surface 4. Such a slide mounting arrangement would also allow storage of the keyboard support beneath the work surface if desired.

The rigid subassembly 8 includes the left support arm 10 and the right support arm 11 maintained in a fixed relationship by the intermediate member 12. This rigid subassembly is pivotally secured to the mounting brackets 6 and 7 about the pivot axis generally shown as 13. With this arrangement, the arms 10 and 11 are free to pivot about the mounting brackets 6 and 7 and the height of the keyboard support can be varied relative to the work surface 4. The distal end 14 of each of the support arms 10 and 1l have the mounting brackets 30 and 32 with Mounting bracket 30 is pivotally attached to the support arm 10 at pivot axis 31 and mounting bracket 32 pivots about axis 34 of arm 11. A keyboard or a keyboard support surface can be directly attached to the mounting brackets 30 and 32. It can be appreciated that the mounting brackets 30 and 32 could be designed for direct support of a keyboard or keyboard and mouse combination.

Figure 2:
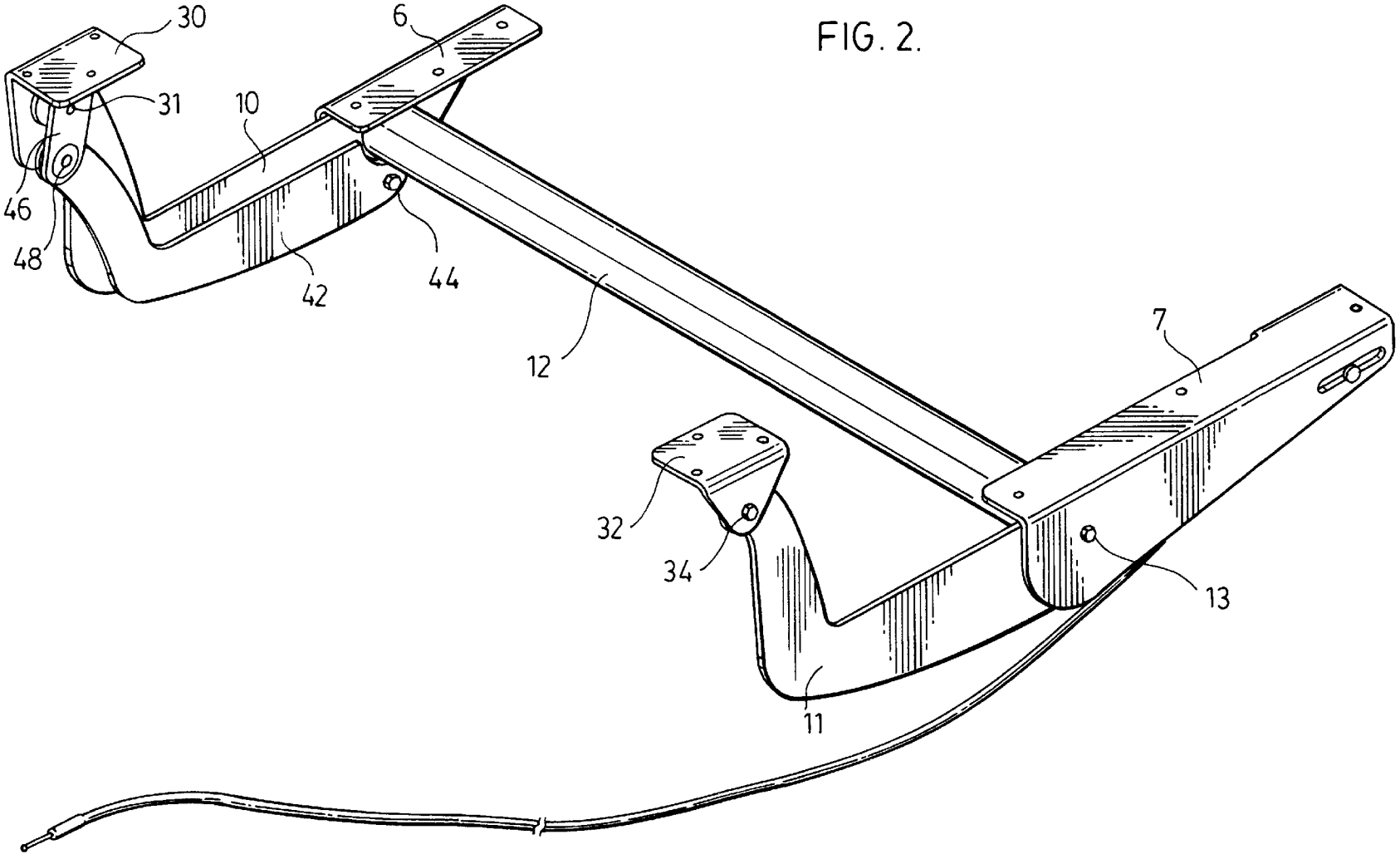

Mounting bracket 32 is free to pivot about axis 34 whereas mounting bracket 30 is controlled by a parallelogram linkage 40 if desired, a second parallelogram linkage 40 can be provided for mounting bracket 32, however, with the many applications, this may not be necessary. Linkage 40 is best shown in FIG. 2 and comprises link member 42 is pivotally attached by pivot axis 44 to the support arm 10. Link member 42 is also attached by pivot axis 48 to the link member 46 which pivots about the fixed pivot axis 31. This is the same pivot axis that the mounting bracket 30 pivots relative to the left support arm 10. Preferably this linkage arrangement is a parallelogram linkage such that the angle of the keyboard or the keyboard support surface mounted to brackets 30 and 32 is maintained with adjustment of the height adjustment mechanism. Pivot shaft 48 also serves as a locking shaft for fixing the angle of the mounting bracket 30 relative to the shaft 48. Locking knob 50 fixes this angle without locking the linkage.

The keyboard support mechanism 2 also includes an adjustable in length link member 18, which in this case is an adjustable in length gas cylinder. This gas cylinder includes a cylinder casing and a piston rod. One end of the cylinder casing is attached on shaft 27 of the right support arm 11. The cylinder rod has the end thereof attached at shaft 26 which is maintained in the slot 28 of the mounting bracket 7. Gravitational force on the keyboard support mechanism forces the support arms 10 and 11 in a downward direction and urges shaft 26 to end 29 of the slot 28. The length of the adjustable link 18 determines the height of the keyboard support surface relative to the work surface 4. The length of the gas cylinder can be varied by having cable 24 actuate the release valve 22 which allows the rod of the gas cylinder to extend. Basically the gas cylinder provides a counterbalance force urging the keyboard support mechanism to a maximum height position. The operator can provide a downward biasing force for urging the keyboard support mechanism to the desired position. When cable control 24 is released the release valve 22 closes and the gas cylinder becomes a fixed length link maintaining the keyboard support mechanism in a desired position.

Slot 28 provides a safety feature in that gravity is basically maintaining the keyboard in the desired location locked by the gas cylinder 18. However, any upward force on the keyboard or keyboard work surface allows the arms 10 and 11 to pivot in a counter-clockwise direction until the gas cylinder reaches the opposite end 20 of slot 28. Therefore, if the operator suddenly stands up causing his thighs to strike the keyboard support surface, the keyboard support surface will move upwardly. Furthermore, if this keyboard support arrangement is attached to an adjustable in height work surface, a sudden lowering of the work surface could trap the operator's legs beneath the keyboard support surface. This slot also acts as a safety feature for such a situation and provides the operator with a safety margin.

The rigid subassembly 8 cooperates with the mounting bracket 6 and 7 to provide a pivot axis 13 which is closely adjacent the bottom of the work surface 4. In this way, the intermediate member 12 is closely adjacent the work surface and is less obtrusive. The rigid subassembly also allows the adjustable in length gas cylinder 18 to be connected to one of the support arms 11 and a mounting bracket 7 while it provides control for the opposite support arm 10. The support arm 10 can have a parallel linkage associated therewith for controlling the angle of the keyboard support as changes in height are accomplished by adjusting the length of the gas cylinder. Therefore, the operating mechanisms have been kept to a minimum and have been divided between the two support arms while the spacing of the support arms can be quite wide thereby further reducing the possibility of obstruction. The wide spacing of support arms 10 and 11 reduces likelihood of the operator striking these arms. This is particularly true in the maximum height position of for the keyboard support arrangement where it can be seen that the arms are essentially parallel beneath the work surface and closely adjacent the bottom of the work surface.

The height adjustable keyboard support 2 is shown in FIG. 3 in a lowered position. It c(an be seen how the adjustable link gas cylinder 18 remains protected by the mounting bracket 7. The lowered position of FIG. 3 is in contrast to the generally full height position of FIG. 1. This mechanism allows height adjustment within a 13 inch range and it can be seen that the configuration of the support arms 10 and 11 are such to reduce or minimize any obstruction that is likely to cause operator contact. The keyboard support surface is also movable through a tilt range of plus or minus 15 degrees.

Figure 5:
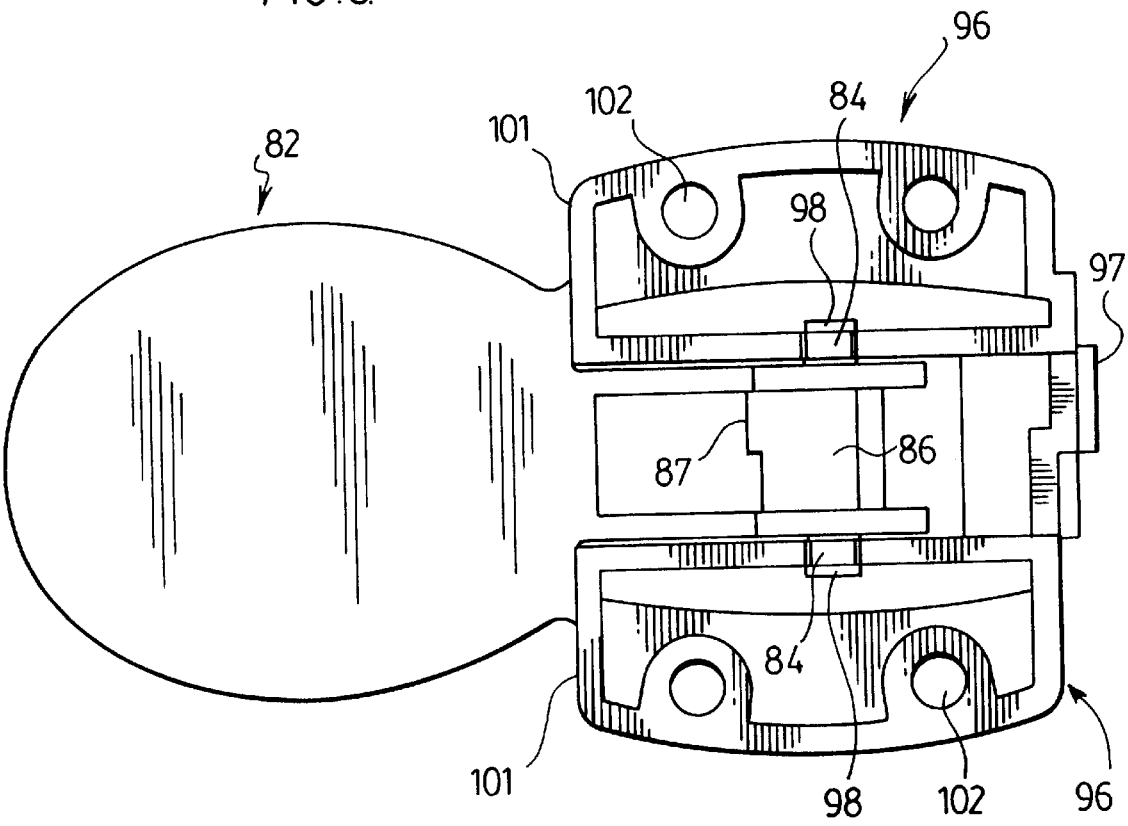
FIG. 5 is a top view of the paddle actuator.

FIGS. 4 and 5 show paddle actuator 80 which is basically a two piece construction comprising the release lever 82 and the face 96. This paddle actuator cooperates with the control cable 24 which has a cable sheath 70 and a wire 71. One end of the wire 71 is generally held in wall 87 of the release lever. This wall is to one side of the pivot axis defined by stub shafts 84 either side of the release lever. These stub shafts are received in slots 98 of the stationary base 96. Cylindrical surface 86 of the release lever 82 cooperates with the underside of the keyboard support work surface to maintain the stub shafts 84 at the bottom of the lot recesses 98 in the base 96. The cable sheath is generally secured to the base 96 by the wall 97. With this arrangement movement of the paddle actuator in the direction indicated by 81 in FIG. 4, causes the wire 71 to release the gas cylinder. Release of the lever 82 causes the gas cylinder to assume its fixed length.

The base 96 includes outwardly extending securing flanges 101 having fastening ports 102 for allowing securement of the base to the lower surface of the keyboard support. The paddle actuator 80 is very convenient in that the release lever 82 can be separated from the base 96 to simplify securement of the wire to the lever. Thereafter the lever can be inserted in the base by positioning the stub shafts 84 in the slots 98 and the actuator then secured to the lower surface of the keyboard support. The release lever 82 and the base 96 are preferably injection moulded and are of plastic material.

The adjustable link 18 in the form of a gas cylinder provides a simple arrangement for providing a counterbalance force when the device is to be adjusted in height. Fixing of the gas cylinder then removes this counterbalancing force until the next adjustment. This feature is advantageously used in combination with the slot 28 to provide for free upward movement against the gravitational force should it be necessary due to operator movement.

Mounting brackets 6 and 7 are shown for mounting beneath a generally horizontal work surface. In some applications, it is desirable to modify these brackets for direct connection to the frame of an office panel. To accomplish this, mounting brackets 6 and 7 are modified to have a panel frame securing a flange or strut at the rear edge thereof to provide cantilevered support for a height adjustment mechanism. With this arrangement, mounting bracket 6 would be lengthened to appropriately position support arms 10 and 11 generally perpendicular to the panel frame. This flange or strut is normally perpendicular to the top surface of the mounting bracket. A keyboard support could be secured to the arms as already described and a small stationary work surface could be attached to the top of the mounting brackets.

The mechanism has been described for use as an adjustable height keyboard support, however, the same mechanism could be used for an adjustable monitor support by securing the mechanism to the rear edge of a work surface. This provides height and angle adjustability.

The arrangement as shown in the Figures is cost effective to produce while providing a very stable keyboard or keyboard support surface. Adjustment in height is highly desired, however, it is also highly desired to have an essentially fixed surface once the desired adjustment has been carried out. With the arrangement as described, both of these desirable features are achieved.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An adjustable height keyboard support for attachment to and support from a work surface comprising two mounting brackets for attachment to a work surface, a rigid subassembly comprising a pair of horizontally spaced pivotting support arms rigidly connected at one end thereof by an intermediate member such that said support arms have a fixed relationship, said subassembly being pivot-ally secured to each of said mounting brackets to define a pivot axis of said subassembly generally parallel to said intermediate member, each of said support arms at a distal end thereof including a tiltable keyboard mounting arrangement located generally between said support arms, said rigid subassembly including an adjustable in length link extending between said subassembly and one of said mounting brackets and maintains said subassembly in a desired position by fixing the length of said adjustable in length link and allows adjustment of said position by adjusting the length of said adjustable link, and wherein said adjustable link is a gas cylinder which when released provides a counterbalance force urging said keyboard mounting arrangement to a raised position; said adjustable link having one end thereof secured in a slot of the associated mounting bracket and gravity urges said one end of said adjustable link to one end of said slot, and said one end of said link is free to move in said slot when said link is locked and an upward force is exerted on said keyboard mounting arrangement.

2. An adjustable in height keyboard support as claimed in claim 1 wherein said keyboard mounting arrangement includes a parallel link mechanism associated with one of said support arms and said keyboard mounting arrangement that maintains a set angle of said keyboard mounting arrangement during adjustment of said keyboard support.

3. An adjustable in height keyboard support comprising a linkage arrangement connected at one end thereof to a work surface and supporting at an opposite end a keyboard support structure, said linkage arrangement accommodating height adjustment of the keyboard support structure adjacent one edge of said work surface, said linkage arrangement including an adjustable in length link which can be locked at various lengths, and when locked, the link determines the operating position of said keyboard support structure based on the length of said link; said linkage arrangement including a safety mounting arrangement whereby said keyboard support with said adjustable in length link locked, being biased by gravity to said operating position and being upwardly movable against said gravity bias without adjustment of said adjustable in length link.

4. An adjustable support as claimed in claim 3 wherein said adjustable in length link when released is spring biased to cause said link to extend and thereby raise said keyboard support structure and wherein one end of said adjustable in length link is maintained at one end of a slot of said safety mounting arrangement and movable against the gravity bias to an opposite end of said slot to provide a safety factor.

5. An adjustable support as claimed in claim 4 wherein said adjustable in length link is a lockable gas cylinder member.

6. An adjustable in height keyboard support as claimed in claim 3 wherein said adjustable in length link is a gas cylinder which when released provides a counterbalance force urging said keyboard support structure to a raised position.

7. An adjustable in height keyboard support as claimed in claim 3 wherein said adjustable in length link is a gas cylinder.

* * * * *